US005944396A

United States Patent [19]

Stephan

[11] Patent Number: 5,944,396

[45] Date of Patent: Aug. 31, 1999

[54] FURNITURE HAVING A CONCEALED DRAWER WITH A DUAL STAGE LOCKING MECHANISM

[76] Inventor: Gerald H. Stephan, 441 Hillvale Turn East, Knoxville, Knox County, Tenn. 37919

[21] Appl. No.: 09/094,070

[22] Filed: Jun. 9, 1998

[51] Int. Cl.[6] ..... A47B 17/04

[52] U.S. Cl. ..... 312/204; 312/333; 70/276

[58] Field of Search ..... 312/204, 292, 312/283, 330.1, 215, 333; 292/251.5; 70/276, DIG. 63, 85, 86; 109/53, 54, 55, 56, 57

[56] References Cited

U.S. PATENT DOCUMENTS

| | | | |
|---|---|---|---|
| 1,512,937 | 10/1924 | Knaster . | |
| 2,934,387 | 4/1960 | Craddock | 312/204 |
| 3,268,282 | 8/1966 | Harvey | 312/204 |
| 4,010,989 | 3/1977 | Klug . | |
| 4,172,424 | 10/1979 | De Palau | 312/204 X |
| 4,252,387 | 2/1981 | Wagner . | |
| 4,366,997 | 1/1983 | Lopez et al. | 312/204 |
| 4,419,939 | 12/1983 | Reverte | 312/204 X |
| 4,838,626 | 6/1989 | Parr . | |
| 4,848,812 | 7/1989 | Slaughter | 70/276 X |
| 4,936,038 | 6/1990 | Johnson et al. . | |
| 5,048,901 | 9/1991 | DeBlaay . | |
| 5,066,079 | 11/1991 | Lawrence . | |
| 5,076,623 | 12/1991 | Richards | 70/276 X |
| 5,111,755 | 5/1992 | Rouse . | |
| 5,482,733 | 1/1996 | Hoffman | 70/276 |
| 5,488,914 | 2/1996 | Ouellette | 70/62 X |
| 5,590,940 | 1/1997 | Richard . | |
| 5,727,291 | 3/1998 | Biondo et al. . | |

*Primary Examiner*—Peter M. Cuomo
*Assistant Examiner*—Hanh V. Tran
*Attorney, Agent, or Firm*—Pitts & Brittian, P.C.

[57] ABSTRACT

A furniture having a concealed drawer with a dual stage locking mechanism for storing and locking particular items in a manner such as to allow two levels of security. The furniture includes a front drawer that is revealed. The front drawer is received within a receptacle defined by a lateral partition disposed proximately at the center of the furniture and a pair of oppositely disposed side aprons. The lateral partition serves to hide the concealed drawer in the event the front drawer is removed. A stop is pivotally mounted to the upper end of the back wall of the front drawer in order to limit the forward travel of the front drawer out of the receptacle. A concealed drawer is disposed behind the lateral partition and on either side or the rear of the furniture. The face of the concealed drawer is configured to look identical to an opposing apron of the furniture, thereby disguising the concealed drawer to anyone who is unaware of its presence. A bottom panel is secured to the bottom of the furniture in order to conceal both the front drawer and the concealed drawer from view from the underneath of the furniture. A first locking mechanism includes a push-button, key-operated lock which is locked simply by pushing a button, and is unlocked using a key. The first locking mechanism may be disposed on either the bottom of the furniture or on the lateral interior partition of the furniture. A second locking mechanism consists of a magnetically operated lock configured to open when a magnet of an opposite pole from a magnet incorporated in the second locking mechanism is placed near the second locking mechanism.

17 Claims, 5 Drawing Sheets

FURNITURE HAVING A CONCEALED DRAWER WITH A DUAL STAGE LOCKING MECHANISM

TECHNICAL FIELD

This invention relates to the field of furniture. More specifically, this invention relates to furniture having a concealed drawer which may be locked using a dual stage locking mechanism, thereby providing varied levels of security for items placed therein.

BACKGROUND ART

In the field of furniture, it is well known to provide concealed enclosures in order to store particular items. Concealed enclosures have been provided for many different uses including the protection or safe-keeping of valuables, the storage of items in otherwise unused space for increased efficiency, and the like. One particular concern in the area of concealed enclosures is the protection of firearms. It is well known that there are many gun owners who keep their weapons in a readily accessible location for protection in the event of an intrusion into their home. In the event of such an intrusion, the firearm may be reached for protection of the gun owner, their family, and perhaps their possessions. As is revealed on regular occasions, an unfortunate occurrence is the accidental discharge of a firearm when found and played with by an untrained individual, and especially a child, often leading to serious injury or death.

Several types of devices have been developed for protecting valuables, clothing articles, or weapons. Typical of the art in concealed furniture and other household fixture enclosures are those devices disclosed in the following U.S. Patents:

| Pat. No. | Inventor(s) | Issue Date |
|---|---|---|
| 4,010,989 | J. R. Klug | Mar. 8, 1977 |
| 4,252,387 | W. E. Wagner | Feb. 24, 1981 |
| 4,838,626 | K. D. Parr | June 13, 1989 |
| 4,936,038 | M. B. Johnson, et al. | June 26, 1990 |
| 5,048,901 | W. E. DeBlaay | Sept. 17, 1991 |
| 5,066,079 | J. L. Lawrence | Nov. 19, 1991 |
| 5,111,755 | M. J. Rouse | May 12, 1992 |
| 5,590,940 | M. B. Richard | Jan. 7, 1997 |

Of these devices, that disclosed by Johnson, et al. ('038), is a handgun keeper concealed by a picture frame. The '038 device provides a storage compartment configured to receive a handgun and hidden behind a typical portrait or other visual work of art. To that extent, the '038 device for being hung on a wall. However, accessing the handgun is simple for one who discovers the compartment. Specifically, the '038 device is comprised of two frame members hinged along one side and magnetically held in a closed position. The hinges are visible, thereby allowing for one's curiosity to be piqued as to what is in the picture frame when they notice the hinges. The '038 device does not provide for any locking mechanism in order to prevent access to the compartment. Further, the '038 device does not teach a two-stage locking mechanism for allowing easy access to the weapon while being locked, or for preventing access to the compartment altogether without destruction of the device or a portion thereof The '755 device disclosed by Rouse is a gun storage apparatus having a child-deterrent latching apparatus. The '755 device includes a dual entry locking apparatus comprised of a keypad and a knob. A particular combination must first be entered on the keyboard, after which a particular sequence of manipulations must be made to the knob in order to gain access to the firearm. The '755 device is mounted to a wall. There are several weaknesses of this device however. Primarily, the device itself is not concealed, nor are the locking devices. For an intruded who sees the device on a wall, the device may be quickly pried off of the wall and removed from the premises prior to removal of the weapon therefrom. More dangerous is the fact that the entry code may be accidentally entered, or through trial and error, until the first locking mechanism is defeated. The second level of securement is easily defeated by manipulating the knob until the receptacle is opened. The '755 device clearly does not teach the concealment thereof, nor the concealment of either of the locking mechanisms.

Klug ('989) teaches a lockable drawer compartment having a receptacle in a drawer with a cover slidably received over the receptacle. The cover may be locked in place by a conventional desk type lock having a latch carried by a lock cylinder. The latch is received within a slotted opening in the cover when the lock cylinder is operated. However, once the drawer is opened, the locked compartment is revealed, and this type of lock is known to be easily defeatable. For that matter, it will be obvious to one looking at the drawer that a locked compartment is disposed therein.

The '387 device disclosed by Wagner is a storage chest having a hidden compartment. The chest is provided with parallel pieces of trim along the bottom of the chest. One piece of trim is removable, while the other is hinged in order to allow the portion of the chest wall between the trim pieces to open via a hinge to reveal the compartment therein. In order to define the compartment, a false bottom is fixed within the chest. There are no provisions for a locking mechanism, and especially not a dual locking mechanism. Therefore, the compartment may be easily found, for example, by someone moving the chest.

The '079 device disclosed by Lawrence is a hidden compartment within a door. While the door is closed, the device is completely hidden. However, when the door is opened, a handle for accessing the compartment is visible on the edge of the door, Further, in the event a handgun is stored within the compartment and the need arises for accessing the handgun, one must open the door, thus risking being noticed.

The '901 device disclosed by DeBlaay is a furniture article having hidden compartments for storing relatively small articles. The compartment is concealed by a removable panel which is held in place merely by a spring which may be easily defeated. Accordingly, there is no real safety provided for the storage of a loaded firearm.

Parr ('626) discloses a security container having a latch assembly operable to release a drawer containing protected contents, such as a firearm. Because there is not a two stage locking device, the compartment is either locked or unlocked, with no provision for protecting the contents of the drawer at an intermediate security level.

Richard ('940) teaches a sliding rack for storing neck ties in a dresser. It is not intended for the sliding tie rack to be concealed to the point that the rack is not noticed. Nor is it a feature of the '940 device to provide any locking mechanism to prevent access to the tie rack.

None of the above-referenced prior art teaches a storage compartment for storing selected articles in a manner such as to allow two levels of security. Particularly, none of the cited prior art would allow a gun owner to secure a loaded weapon in a concealed compartment to prevent a child, for example, from gaining access thereto. When the gun owner is present, the prior art does not allow for the unlocking of one locking mechanism to allow for quick and easy access to the weapon, while still preventing access to children. Then when the gum owner leaves the premises, the prior art does not allow for the simple locking of the first locking mechanism to prevent access to the compartment without destruction of the device. Further, the prior art cited does not disclose such a device hidden from view in an otherwise standard article of furniture.

Therefore, it is an object of this invention to provide a means for storing and locking particular items in a manner such as to allow two levels of security.

Particularly, it is an object of the present invention to provide such a device whereby a first level of security includes a first locking mechanism preventing access to the contents therein without destruction of the device itself, and whereby a second level of security includes a second locking mechanism which may be quickly operated to open the compartment to reveal the contents therein.

Further, it is an object of the present invention to provide such a device which is concealed in a piece of furniture which appears to be a conventional piece of furniture, with minimal visual clues as to the presence of a hidden compartment.

DISCLOSURE OF THE INVENTION

Other objects and advantages will be accomplished by the present invention which is provided for storing and locking particular items in a manner such as to allow two levels of security. Particularly, the furniture is designed to provide a first level of security including a first locking mechanism preventing access to the contents therein without destruction of the device itself, and a second level of security including a second locking mechanism which may be quickly operated to open the compartment to reveal the contents therein. The furniture of the present invention is designed to appear to be a conventional piece of furniture.

The furniture includes a front drawer that is revealed and may be used for storing various items for ready access. The front drawer is received within a receptacle defined by a lateral partition disposed proximately at the center of the furniture and a pair of oppositely disposed side aprons. The lateral partition serves to hide the concealed drawer in the event the front drawer is removed. A stop is pivotally mounted to the upper end of the back apron of the front drawer in order to limit the forward travel of the front drawer out of the receptacle. A concealed drawer is disposed behind the lateral interior partition and on either side or the rear of the furniture.

The face of the concealed drawer is configured to look identical to an opposing apron of the furniture, thereby disguising the concealed drawer to anyone who is unaware of its presence. The apron of the furniture proximate the concealed drawer face is disposed farther away from the outside of the furniture than the opposing apron by a distance equal to the thickness of the concealed drawer face such that when the concealed drawer is closed, the concealed drawer face appears to be an apron. In order to completely conceal the concealed drawer, a bottom panel is secured to the bottom of the furniture. In this manner, both the front drawer and the concealed drawer are hidden from view from the underneath of the furniture.

The furniture of the present invention includes a dual locking system to provide two levels of security. A first locking mechanism includes a push-button, key-operated lock which is locked simply by pushing a button, and is unlocked using a key. The first locking mechanism may be disposed on either the bottom of the furniture or on the lateral interior partition of the furniture. In the former embodiment, the first locking mechanism is the only visible portion of the concealed drawer which may be seen from outside the furniture. In the latter embodiment, the first locking mechanism is visible only when the front drawer is removed from the device, thereby providing greater secrecy.

In the former embodiment wherein the first locking mechanism is mounted on the bottom of the furniture, a slide is mounted on the bottom of the concealed drawer in the direction of travel of the concealed drawer. The slide defines an opening positioned to cooperate with a pin carried by the first locking mechanism. When the button is depressed, the pin is moved into the slide opening until the first locking mechanism is locked. Therefore, the concealed drawer is prevented from opening until the pin is drawn from receipt in the slide opening. In the latter embodiment wherein the first locking mechanism is mounted on the lateral interior partition, a side apron of the concealed drawer proximate the interior lateral partition defines an opening proximate the first locking mechanism for receipt of the locking pin. In either embodiment, the first locking mechanism provides the greatest level of security in that it may be opened only with the proper key, unless destruction of the furniture is accomplished.

A second locking mechanism consists of a magnetically operated lock configured to open when a magnet of an opposite pole from a magnet incorporated in the second locking mechanism is placed near the second locking mechanism. A latch is normally biased in an open position such that it is at least partially disposed behind the furniture side apron. When the magnet is placed near the second locking mechanism, the latch is pivoted into the second locking mechanism, thus providing clearance between the latch and the furniture side apron opening through which the concealed drawer is received, thereby allowing the concealed drawer to be opened. The second locking mechanism may be maintained in an unlocked position if desired in order to further make the contents of the concealed drawer more accessible.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

An article of furniture having a concealed drawer with a dual stage locking mechanism incorporating various features of the present invention is illustrated generally at 10 in the figures. The furniture having a concealed drawer with a dual stage locking mechanism, or furniture 10, is designed for storing and locking particular items in a manner such as to allow at least two levels of security. Particularly, the furniture 10 is designed to provide a first level of security including a first locking mechanism 50 preventing access to the contents therein without destruction of the furniture 10 itself, and a second level of security including a second locking mechanism 56 which may be quickly operated to open the concealed drawer 32 to reveal the contents therein. It will be seen by those skilled in the art that additional locking mechanisms and/or alarms may be added to the present invention in order to provide greater security for the concealed drawer 32 and/or deterrence from unauthorized entrance therein. The furniture 10 of the present invention is further designed to appear as a conventional piece of furniture, with minimal visual clues as to the presence of a concealed drawer 32.

Figure 1:
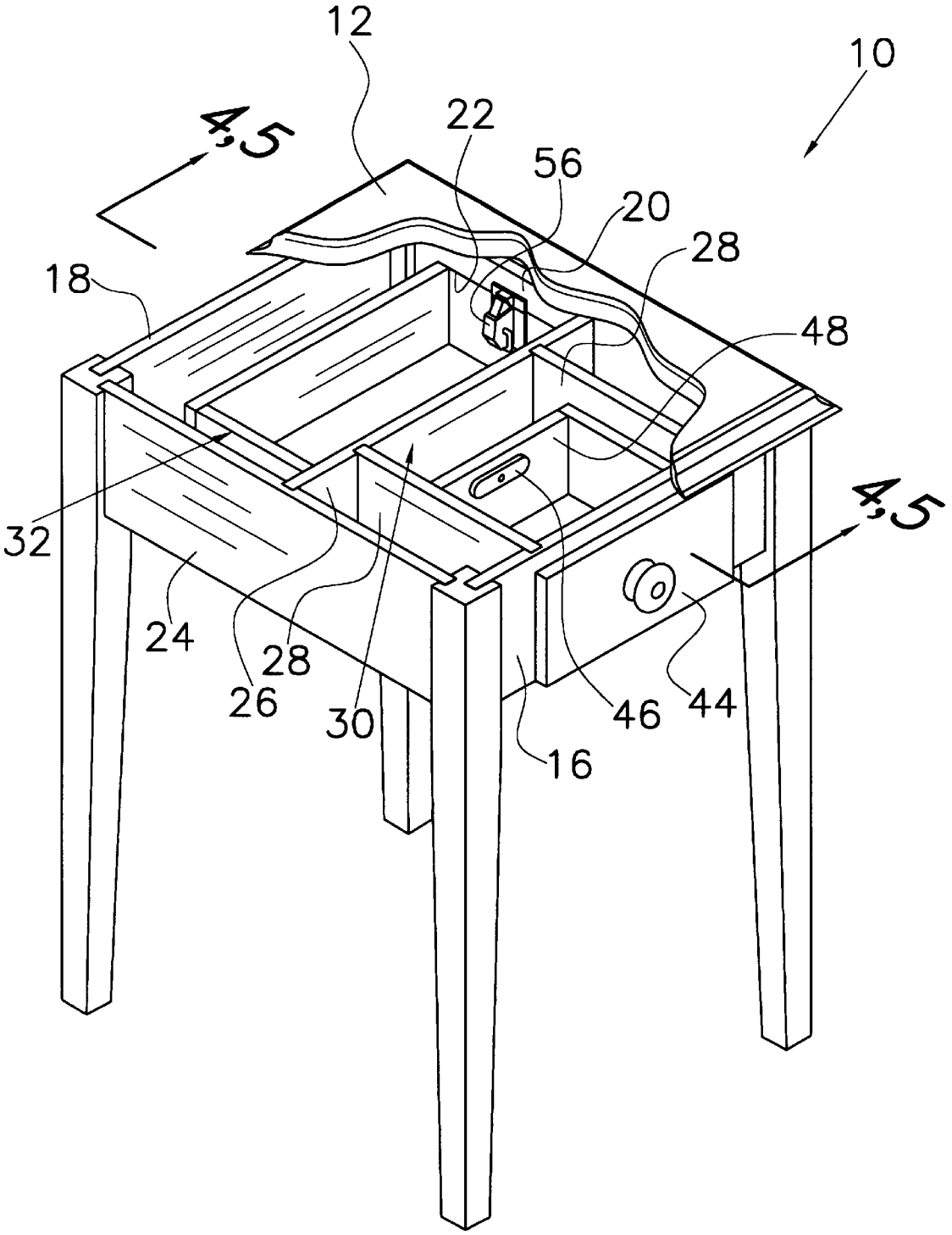
FIG. 1 is a perspective view of the furniture having a concealed drawer with a dual stage locking mechanism constructed in accordance with several features of the present invention showing a portion of the table top being removed.

As illustrated in FIG. 1, the preferred embodiment of the present invention is incorporated in an occasional table. However, it will be understood that other configurations or types of furniture may be modified to incorporated the present invention as well. A substantial portion of the furniture top 12 is removed for clarity of the invention. The furniture 10 includes a front drawer 44 that is revealed and may be used for storing various items for ready access. The front drawer 44 is received within a receptacle 30 defined by a lateral partition 26 disposed proximately at the center of the furniture 10 and a pair of oppositely disposed side partitions 28. Although the pair of side partitions 28 illustrated is independent of the furniture side aprons 20,24, they may be omitted. However, the lateral partition 26 is required in order to hide the concealed drawer 32, as will be discussed below, in the event the front drawer 44 is removed. A stop 46 is pivotally mounted to the upper end of the back apron 48 of the front drawer 44 in order to limit the forward travel of the front drawer 44 out of the receptacle 30. The stop 46 defines a substantially rectangular configuration such that when pivoted to a horizontal disposition, the front drawer 44 may be removed. However orientation in a vertical disposition prevents removal of the front drawer 44. It will be understood by those skilled in the art that the furniture 10 of the present invention may be configured without the front drawer 44 without losing the novelty of the present invention. In such an instance, it will be seen that the lateral partition 26 is obviated.

A concealed drawer 32 is disposed behind the lateral partition 26 and on either side 20,24 or the rear 18 of the furniture 10. Typically the concealed drawer 32 is disposed on one of the sides 20,24 of the furniture 10 as the illustrated embodiment is designed to be placed against a wall. For ease of discussion, the concealed drawer 32 will herein be described as being disposed within an opening 22 defined by the first side apron 20, without description of being disposed on the left or right side of the furniture 10. Therefore, it will be understood that the concealed drawer 32 may be disposed on either side of the furniture 10.

Figure 2:
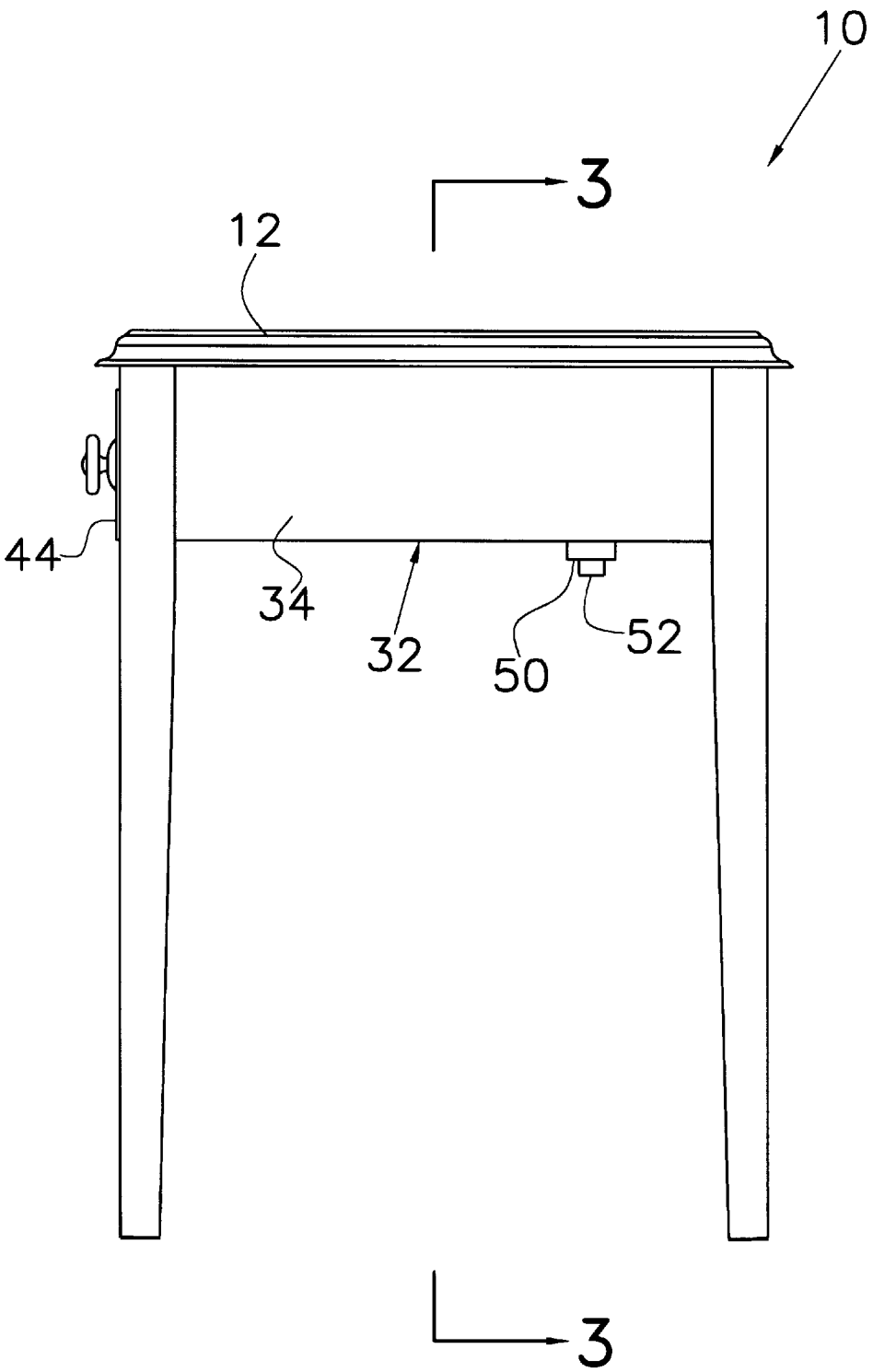
FIG. 2 illustrates a side elevation view of the furniture having a concealed drawer with a dual stage locking mechanism of FIG. 1.

Illustrated in FIG. 2 is a side elevation of the furniture 10 of the present invention showing the face 34 of the concealed drawer 32. The face 34 of the concealed drawer 32 is configured to look identical to the second side apron 24 of the furniture 10, thereby disguising the concealed drawer 32 to anyone who is unaware of its presence. As better illustrated in FIG. 3, the first side apron 20 of the furniture 10 is disposed farther away from the outside of the furniture 10 than the second side apron 24 by a distance equal to the thickness of the concealed drawer face 34. Therefore, when the concealed drawer 32 is closed, the concealed drawer face 34 appears identical to the second side apron 24.

In order to completely conceal the concealed drawer 32, a bottom panel 14 is secured to the bottom of the furniture 10. In this manner, both the front drawer 44 and the concealed drawer 32 are hidden from view from the underneath of the furniture 10. Further, the top panel 12 is secured to the front, rear and first and second side aprons 16,18,20,24 and interior lateral partition 26 such that the concealed drawer 32 is disposed within a tightly contained and sturdy construction.

Figure 3:
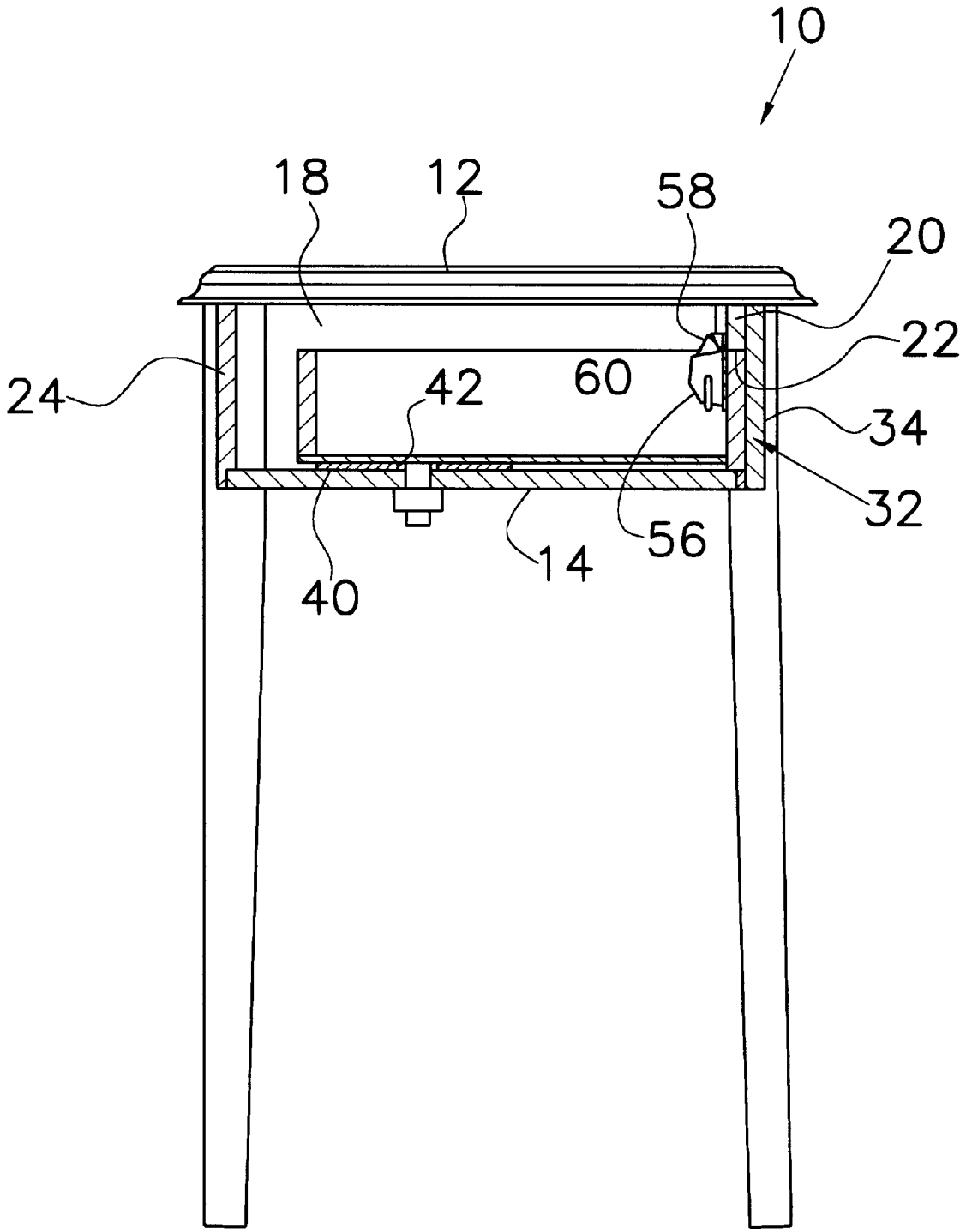
FIG. 3 is a front elevation view of the present invention taken at 3—3 of FIG. 2.
Figure 4:
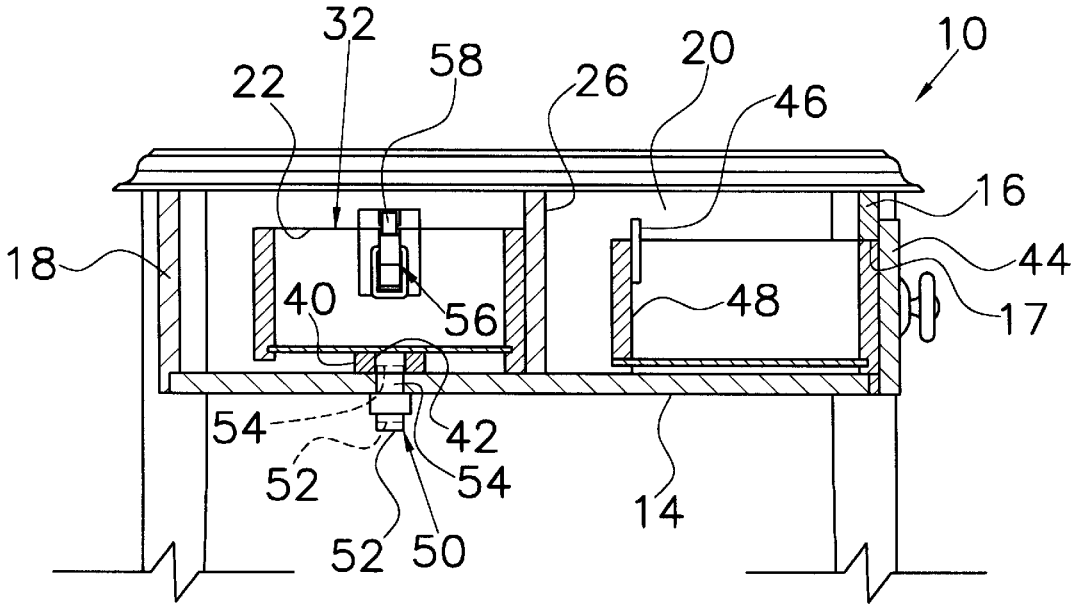
FIG. 4 illustrates a partial side elevation view of the present invention taken at 4—4 of FIG. 1.
Figure 5:
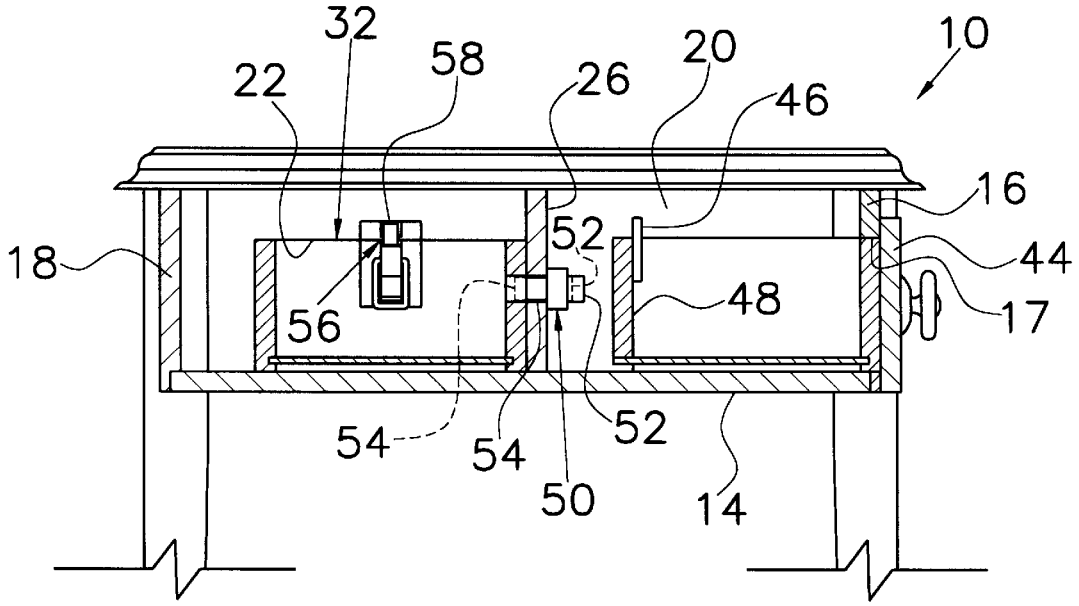
FIG. 5 illustrates a partial side elevation view of an alternate embodiment the present invention taken at 5—5 of FIG. 1.

The furniture 10 of the present invention includes a dual locking system to provide two levels of security. A first locking mechanism 50 includes a push-button, key-operated lock. Specifically, the first locking mechanism 50 is locked simply by pushing a button 52, and is unlocked using a key (not shown). The first locking mechanism 50 may be disposed on the bottom of the furniture 10 as illustrated in FIGS. 3 and 4, or may be disposed on the lateral interior partition 26 of the furniture 10 as illustrated in FIG. 5. In the former embodiment, the first locking mechanism 50 is the only visible portion of the concealed drawer 32 which may be seen from outside the furniture 10. In the latter embodiment, the first locking mechanism 50 is visible only when the front drawer 44 is removed from the furniture 10, thereby providing greater secrecy.

In the embodiment illustrated in FIGS. 3 and 4, a slide 40 is mounted on the bottom of the concealed drawer 32 in the direction of travel of the concealed drawer 32. The slide 40 defines an opening 42 positioned to cooperate with a pin 54 carried by the first locking mechanism 50. When the button 52 is depressed, the pin 54 is moved into the slide opening 42 until the first locking mechanism 50 is locked. Therefore, the concealed drawer 32 is prevented from opening until the pin 54 is drawn from receipt in the slide opening 42.

In the embodiment illustrated in FIG. 5, a concealed drawer side wall 36 defines an opening 38 proximate the first locking mechanism 50 for receipt of the locking pin 54.

In either embodiment, the first locking mechanism 50 provides the greatest level of security in that it may be opened only with the proper key, unless destruction of the furniture 10 is accomplished. A gun owner, for example, may desire to lock the first locking mechanism 50 while away from the residence, and unlock the first locking mechanism 50 only when he is in full control of the access to the handgun stored in the concealed drawer 32.

Figure 3A:
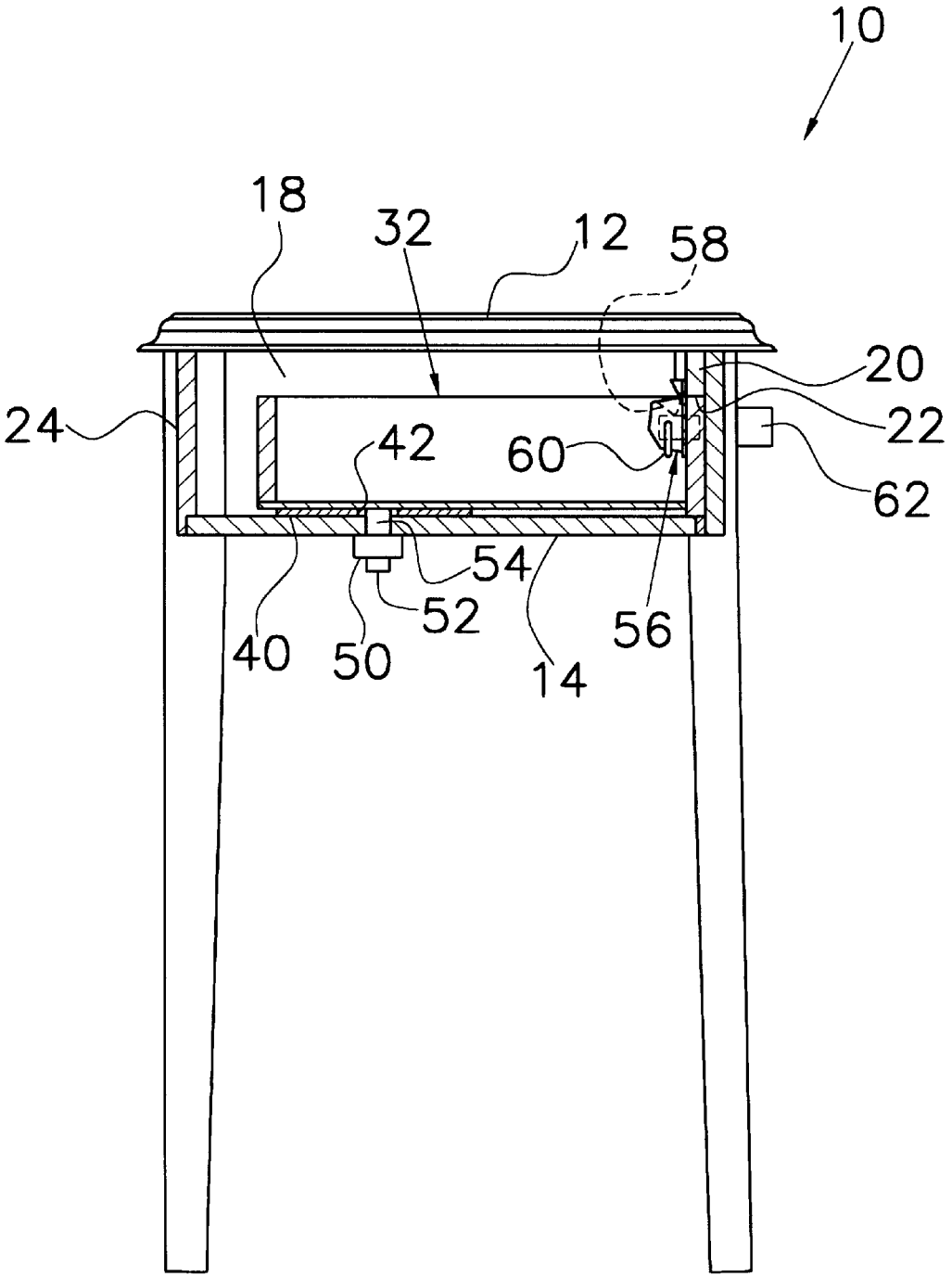
FIG. 3A is a front elevation view of a portion of the present invention as shown in FIG. 3, showing the second locking mechanism being actuated by a magnetic actuator.

When the first locking mechanism 50 is unlocked, the concealed drawer remains locked so long as a second locking mechanism 56 is locked. The second locking mechanism 56 of the preferred embodiment is a magnetically operated lock configured to open when a magnet 62 of an opposite pole from a magnet (not shown) incorporated in the second locking mechanism 56 is placed near the second locking mechanism 56. A latch 58 is normally biased in an open position such that it is at least partially disposed behind the furniture first side apron 20. The latch 58 is so configured such that when the concealed drawer 32 is pushed closed, the second locking mechanism 56 automatically locks the concealed drawer 32. When the magnet 62 is placed near the second locking mechanism 56, the latch 58 is pivoted into the second locking mechanism 56, as illustrated in FIG. 3A, providing clearance between the latch 58 and the first side apron opening 22 through which the concealed drawer 32 is received, thereby allowing the concealed drawer 32 to be opened. Thus, at selected times when the first locking mechanism 50 is unlocked, such as during sleeping hours, when access to the concealed drawer 32 is required, the second locking mechanism 56 is opened by passing the magnet 62 over the location of the second locking mechanism 56 until the latch 58 is opened, and then by pulling the concealed drawer 32 open to reveal the contents therein. The second locking mechanism 56 may be maintained in an unlocked position if desired in order to further make the contents of the concealed drawer 32 more accessible. As magnetic locks of the type incorporated are known, most provide for a latch stop 60 for maintaining the latch 58 in an open position.

Although the present invention is described as having first and second locking mechanisms 50,56 of particular designs, it will be understood that other various types of locking mechanisms may be substituted with equal or better results. Accordingly, it is not intended that either of these locking mechanisms 50,56 be limited to those described, but is intended to include any dual locking system which provides at least two levels of security for protecting items disposed in the concealed drawer 32.

From the foregoing description, it will be recognized by those skilled in the art that a furniture having a concealed drawer with a dual stage locking mechanism offering advantages over the prior art has been provided. Specifically, the furniture provides a concealed drawer in a piece of furniture whereby valuables, firearms, or other selected items may be secretly kept. The present invention includes a dual locking system whereby two levels of security may be maintained, including a first locking mechanism which may be easily locked by depressing a button, but opened only with the appropriate key, and a second locking mechanism completely hidden from view and operated magnetically. The present invention is designed such that the concealed drawer is completely hidden from view, including when looking at the bottom of the furniture, and when looking into a receptacle defined within the furniture for receiving a front drawer. When both locking mechanisms are engaged, the only manner by which one may gain access to the contents of the concealed drawer is to either destroy the furniture or use the appropriate key and magnet. However, the furniture of the present invention is configured so as to not give the appearance that any concealed compartment is present.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention,

I claim:

1. An article of furniture for storing and locking particular items, said article of furniture comprising:

a first side apron and a second side apron, a front apron and a rear apron, said first and second side aprons, said front apron and said rear apron combining to define an interior of said article of furniture;

a bottom panel configured to conceal said interior of said article of furniture, said bottom panel being secured to each of said first and second side aprons, and said front and rear aprons;

a top panel configured to cover said interior of said article of furniture, said top panel being secured to each of said first and second side aprons, and said front and rear aprons, said top panel defining a periphery;

a concealed drawer received within said interior through an opening defined in said first side apron, said first side apron being disposed inwardly of said top panel periphery a distance equal to a thickness of a face of said concealed drawer plus a distance said second side apron is disposed inwardly of said top panel periphery, said face of said concealed drawer being configured and disposed to define a mirror image of said second side apron;

a first locking mechanism for selectively locking said concealed drawer from unauthorized access excluding destruction of said article of furniture; and a second locking mechanism for selectively locking said concealed drawer from unauthorized access excluding destruction of said article of furniture.

2. The article of furniture of claim 1 wherein said first locking mechanism includes a push-button, key-operated lock, said first locking mechanism being locked by pushing a button and unlocked using a key.

3. The article of furniture of claim 1 wherein said first locking mechanism is disposed on said bottom panel of said article of furniture.

4. The article of furniture of claim 1 wherein said second locking mechanism includes a magnetically operated lock configured to open when a magnet of an opposite pole from a magnet incorporated in said second locking mechanism is placed near said second locking mechanism, said second locking mechanism including a latch normally biased in an open position at least partially disposed behind said first side apron, said latch being pivoted into said second locking mechanism when said magnet is placed near said second locking mechanism.

5. The article of furniture of claim 4 wherein said second locking mechanism further includes a latch stop for selectively maintaining said latch in an open position.

6. The article of furniture of claim 1 further comprising:

a lateral partition extending between said first and second side aprons within said interior, said concealed drawer being disposed behind said lateral partition, and a front drawer received within said interior through an opening defined by said front apron, said lateral partition concealing said concealed drawer from view when said front drawer is removed from said article of furniture.

7. The article of furniture of claim 6 further comprising a stop pivotally mounted to said front drawer in order to limit forward travel of said front drawer.

8. The article of furniture of claim 6 wherein said first locking mechanism is disposed on said lateral partition of said article of furniture.

9. An article of furniture for storing and locking particular items, said article of furniture comprising:

a first side apron and a second side apron, a front apron and a rear apron, said first and second side aprons, said front apron and said rear apron combining to define an interior of said article of furniture;

a bottom panel configured to conceal said interior of said article of furniture, said bottom panel being secured to each of said first and second side aprons, and said front and rear aprons;

a top panel configured to cover said interior of said article of furniture, said top panel being secured to each of said first and second side aprons, and said front and rear aprons, said top panel defining a periphery;

a concealed drawer received within said interior through an opening defined in said first side apron, said first side apron being disposed inwardly of said top panel periphery a distance equal to a thickness of a face of said concealed drawer plus a distance said second side apron is disposed inwardly of said top panel periphery, said face of said concealed drawer being configured and disposed to define a mirror image of said second side apron;

a first locking mechanism for selectively locking said concealed drawer from unauthorized access excluding destruction of said article of furniture, said first locking mechanism including a push-button, key-operated lock, said first locking mechanism being locked by pushing a button and unlocked using a key; and a second locking mechanism for selectively locking said concealed drawer from unauthorized access excluding destruction of said article of furniture, said second locking mechanism including a magnetically operated lock configured to open when a magnet of an opposite pole from a magnet incorporated in said second locking mechanism is placed near said second locking mechanism, said second locking mechanism including a latch normally biased in an open position at least partially disposed behind said first side apron, said latch being pivoted into said second locking mechanism when said magnet is placed near said second locking mechanism.

10. The article of furniture of claim 9 wherein said first locking mechanism is disposed on said bottom panel of said article of furniture.

11. The article of furniture of claim 9 wherein said second locking mechanism further includes a latch stop for selectively maintaining said latch in an open position.

12. The article of furniture of claim 9 further comprising:

a lateral partition extending between said first and second side aprons within said interior, said concealed drawer being disposed behind said lateral partition; and a front drawer received within said interior through an opening defined by said front apron, said lateral partition concealing said concealed drawer from view when said front drawer is removed from said article of furniture.

13. The article of furniture of claim 12 further comprising a stop pivotally mounted to said front drawer in order to limit forward travel of said front drawer.

14. The article of furniture of claim 12 wherein said first locking mechanism is disposed on said lateral partition of said article of furniture.

15. An article of furniture for storing and locking particular items, said article of furniture comprising:

a first side apron and a second side apron, a front apron and a rear apron, said first and second side aprons, said front apron and said rear apron combining to define an interior of said article of furniture;

a lateral partition extending between said first and second side aprons within said interior;

a bottom panel configured to conceal said interior of said article of furniture, said bottom panel being secured to each of said first and second side aprons, said front and rear aprons, and said lateral partition;

a top panel configured to cover said interior of said article of furniture, said top panel being secured to each of said first and second side aprons, and said front and rear aprons, said top panel defining a periphery;

a front drawer received within said interior through an opening defined by said front apron;

a stop pivotally mounted to said front drawer in order to limit forward travel of said front drawer;

a concealed drawer received within said interior through an opening defined in said first side apron disposed behind said lateral partition, said lateral partition concealing said concealed drawer from view when said front drawer is removed from said article of furniture, said first side apron being disposed inwardly of said top panel periphery a distance equal to a thickness of a face of said concealed drawer plus a distance said second side apron is disposed inwardly of said top panel periphery, said face of said concealed drawer being configured and disposed to define a mirror image of said second side apron;

a first locking mechanism for selectively locking said concealed drawer from unauthorized access excluding destruction of said article of furniture, said first locking mechanism including a push-button, key-operated lock, said first locking mechanism being locked by pushing a button and unlocked using a key; and a second locking mechanism for selectively locking said concealed drawer from unauthorized access excluding destruction of said article of furniture, said second locking mechanism including a magnetically operated lock configured to open when a magnet of an opposite pole from a magnet incorporated in said second locking mechanism is placed near said second locking mechanism, said second locking mechanism including a latch normally biased in an open position at least partially disposed behind said first side apron, said latch being pivoted into said second locking mechanism when said magnet is placed near said second locking mechanism, said second locking mechanism further including a latch stop for selectively maintaining said latch in an open position.

16. The article of furniture of claim 15 wherein first locking mechanism is disposed on said bottom panel of said article of furniture.

17. The article of furniture of claim 15 wherein said first locking mechanism is disposed on said lateral partition of said article of furniture.

* * * * *